US011518167B2

(12) United States Patent
Kobayashi

(10) Patent No.: US 11,518,167 B2
(45) Date of Patent: Dec. 6, 2022

(54) LIQUID JET DEVICE, HEAD BODY, AND METHOD OF MOUNTING HEAD BODY

(71) Applicant: SEIKO EPSON CORPORATION, Tokyo (JP)

(72) Inventor: Masaki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 17/104,673

(22) Filed: Nov. 25, 2020

(65) Prior Publication Data

US 2021/0162755 A1 Jun. 3, 2021

(30) Foreign Application Priority Data

Nov. 28, 2019 (JP) ..... JP2019-215108

(51) Int. Cl.
*B41J 2/14* (2006.01)
*B41J 2/16* (2006.01)

(52) U.S. Cl.
CPC .... *B41J 2/1433* (2013.01); *B41J 2002/14491* (2013.01)

(58) Field of Classification Search
CPC ..... B41J 2/14; B41J 2/14008; B41J 2/14016; B41J 2/14024; B41J 2/14201; B41J 2/1601; B41J 2/1607; B41J 2/1648; B41J 2/235
See application file for complete search history.

(56) References Cited

U.S. PATENT DOCUMENTS 6,315,385 B1 * 11/2001 Te ..... B41J 2/1631 347/20
2007/0046727 A1 * 3/2007 Yanagisawa ..... B41J 2/1632 347/47
2009/0058935 A1 * 3/2009 Owaki ..... B41J 2/14233 347/47

FOREIGN PATENT DOCUMENTS

JP 2010-036365 2/2010

* cited by examiner

*Primary Examiner* — Jason S Uhlenhake
(74) *Attorney, Agent, or Firm* — Workman Nydegger

(57) ABSTRACT

A liquid jet device includes a head body configured to jet droplets from a nozzle, a frame at which the head body is positioned, a grounding portion configured to contact a first side surface of the head body in a removal direction from the frame to electrically couple the head body to the frame, and a first pin serving as a pin for positioning the head body with respect to the frame, wherein a contact position between the first side surface and the grounding portion and a position of the first pin overlap in a normal direction of the first side surface.

6 Claims, 5 Drawing Sheets

LIQUID JET DEVICE, HEAD BODY, AND METHOD OF MOUNTING HEAD BODY

The present application is based on and claims priority from JP Application Serial Number 2019-215108, filed Nov. 28, 2019, the disclosure of that is hereby incorporated by reference herein in its entirety.

BACKGROUND

1. Technical Field

The present disclosure relates to a liquid jet device, a head body, and a method of mounting the head body.

2. Related Art

For example, in a liquid jet device described in JP-A-2010-36365, a head body which jets droplets from a nozzle is positioned on and fixed to a frame. A first mounting plate having an insertion hole through which a fixing pin for positioning is inserted and a second mounting plate having a cutout portion through which an adjusting pin for positioning is inserted are provided at two locations on the outer peripheral portion of the head body. The head body is fixed to the frame by inserting a portion below the first mounting plate and the second mounting plate into a mounting hole formed in the frame and positioned by the fixing pin and the adjusting pin while the first mounting plate and the second mounting plate are in contact with a peripheral edge portion of the mounting hole from above. Then, in a state in which the head body is fixed to the frame in this way, a tip end of a grounding portion which extends from the frame side laterally comes into contact with one side surface below the first mounting plate and the second mounting plate in the head body, and thus grounding of the head body is planned.

In the above-described liquid jet device according to the related art, when the head body is removed from the mounting hole of the frame, for example, such as during replacement of the head body, the head body is removed from the mounting hole while being incrementally shaken in a direction intersecting a removal direction from the mounting hole. That is, the head body is removed from the mounting hole upward while a portion thereof which is in contact with the tip end of the grounding portion below the first mounting plate and the second mounting plate is incrementally shaken to rotate about a position of the fixing pin or the adjusting pin above the first mounting plate and the second mounting plate. Thus, when the head body is removed upward from the mounting hole while being incrementally shaken in such a manner, there is a problem that a sliding contact load in the removal direction from the mounting hole occurs at a contact portion with the tip end of the grounding portion in the head body, which is undesirable.

SUMMARY

A liquid jet device which solves the above problems includes a head body configured to jet droplets from a nozzle, a frame at which the head body is positioned, a grounding portion configured to contact a first side surface of the head body in a removal direction from the frame to electrically couple the head body to the frame, and a first pin serving as a pin for positioning the head body with respect to the frame, wherein a contact position between the first side surface and the grounding portion and a position of the first pin overlap in a normal direction of the first side surface.

DESCRIPTION OF EXEMPLARY EMBODIMENTS

Figure 1:
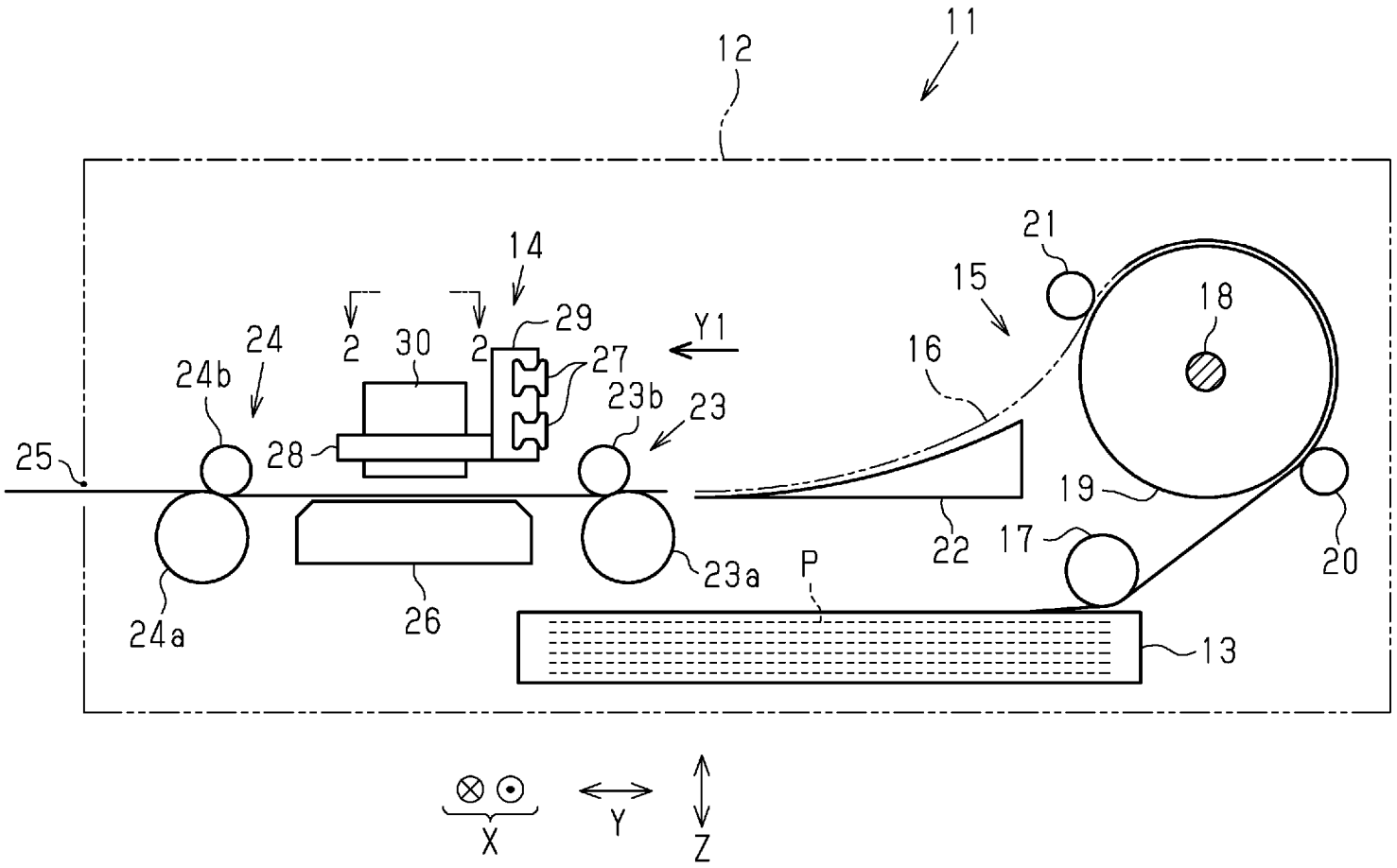
FIG. 1 is a side cross-sectional view schematically showing an internal configuration of a liquid jet device.

One exemplary embodiment of a liquid jet device will be described below with reference to the accompanying drawings. In FIG. 1, the liquid jet device 11 is placed on a horizontal surface, and a vertical direction in FIG. 1 is referred to as a vertical direction Z. In addition, in two directions orthogonal to the vertical direction Z when the liquid jet device 11 is seen from the front which is a left side surface in FIG. 1, a direction orthogonal to a plane of the drawing in FIG. 1 is referred to as a width direction X, and a left and right direction in FIG. 1 is a depth direction Y. In the depth direction Y, the left side in FIG. 1 is the front side or the front surface side, and the right side in FIG. 1 is the rear side or the back surface side.

As shown in FIG. 1, a liquid jet device 11 includes a device body 12 which serves as a housing. A medium accommodation unit 13 which can accommodate a medium P, such as paper, in a stacked state, a liquid jet unit 14 which jets droplets of ink or the like that is an example of a liquid with respect to the medium P, and a medium transporting unit 15 configured to transport the medium P from the medium accommodation unit 13 toward the liquid jet unit 14 are provided in the device body 12. In other words, the liquid jet device 11 according to the present embodiment is an ink-jet type printer which forms an image of text, graphics, and the like on the medium P by jetting droplets from the liquid jet unit 14 onto the medium P transported through a transport path 16 passing through the liquid jet unit 14 by the medium transporting unit 15.

The medium transporting unit 15 includes a feeding roller 17 which feeds individual sheets of the medium P to the downstream side, on which the liquid jet unit 14 is located, by rotating while the feeding roller is in contact with an uppermost sheet of the medium P of the plurality sheets of the medium P stacked in the medium accommodation unit 13. An inversion roller 19 which rotates about an axis 18 along the width direction X is provided at a position located downstream from the feeding roller 17 and above the feeding roller 17 in a feeding direction of the medium P. The inversion roller 19 inverts the medium P sent from the medium accommodation unit 13 to the inversion roller 19 by the feeding roller 17 and transports the medium P to the downstream side by rotating in a counterclockwise direction in FIG. 1 in a state in which the medium P is wound around a peripheral surface thereof.

Two driven rollers 20 and 21 which are driven to rotate with the medium P interposed between the two driven rollers 20 and 21 and the inversion roller 19 are rotatably provided around the inversion roller 19. A guide member 22 which guides the medium P so that the medium P sent to the downstream side from the peripheral surface of the inversion roller 19 is transported toward the liquid jet unit 14 on the front side is provided at the diagonally lower front of the driven roller 21 of the two driven rollers 21 and 22 which is located on the downstream side in a transport direction of the medium P. That is, when the medium P travels from the inversion roller 19 to the liquid jet unit 14 through the guide member 22 along the transport path 16, the medium P is transported in a transport direction Y1 which is a direction from the rear side to the front side in the depth direction Y.

Further, the medium transporting unit 15 includes a transport roller pair 23 and a discharge roller pair 24 on the downstream side in the transport direction Y1 of the guide member 22. In the transport direction Y1 of the medium P, the transport roller pair 23 is provided upstream from the liquid jet unit 14, and the discharge roller pair 24 is provided downstream from the liquid jet unit 14. The transport roller pair 23 and the discharge roller pair 24 respectively include driving rollers 23*a* and 24*a* and driven rollers 23*b* and 24*b* and transport the medium P in a horizontal direction along the depth direction Y. Then, the medium P on which the droplets are jetted by the liquid jet unit 14 to form an image is transported further downstream from the liquid jet unit 14 as the discharge roller pair 24 rotates, and is discharged to the outside via a discharge port 25 which is formed to open to a side wall of the device body 12.

The liquid jet unit 14 includes a medium support portion 26 which supports the medium P, that is sandwiched between the transport roller pair 23 and the discharge roller pair 24 and transported to the downstream side, from the lower surface side thereof. The medium support portion 26 is a support base formed in a rectangular shape in a plan view in which the width direction of the medium P that is also the width direction X of the device body 12 is a longitudinal direction thereof and a longitudinal length thereof is longer than a width dimension of the medium P. In addition, a pair of upper and lower guide rails 27 are mounted at a position above the medium support portion 26 in the vertical direction Z to extend in the width direction X. Additionally, the guide rails 27 are supported so that a movable body 29 supporting a frame 28 in a cantilevered manner reciprocates in the width direction X which is a scanning direction with respect to the medium P.

Figure 2:
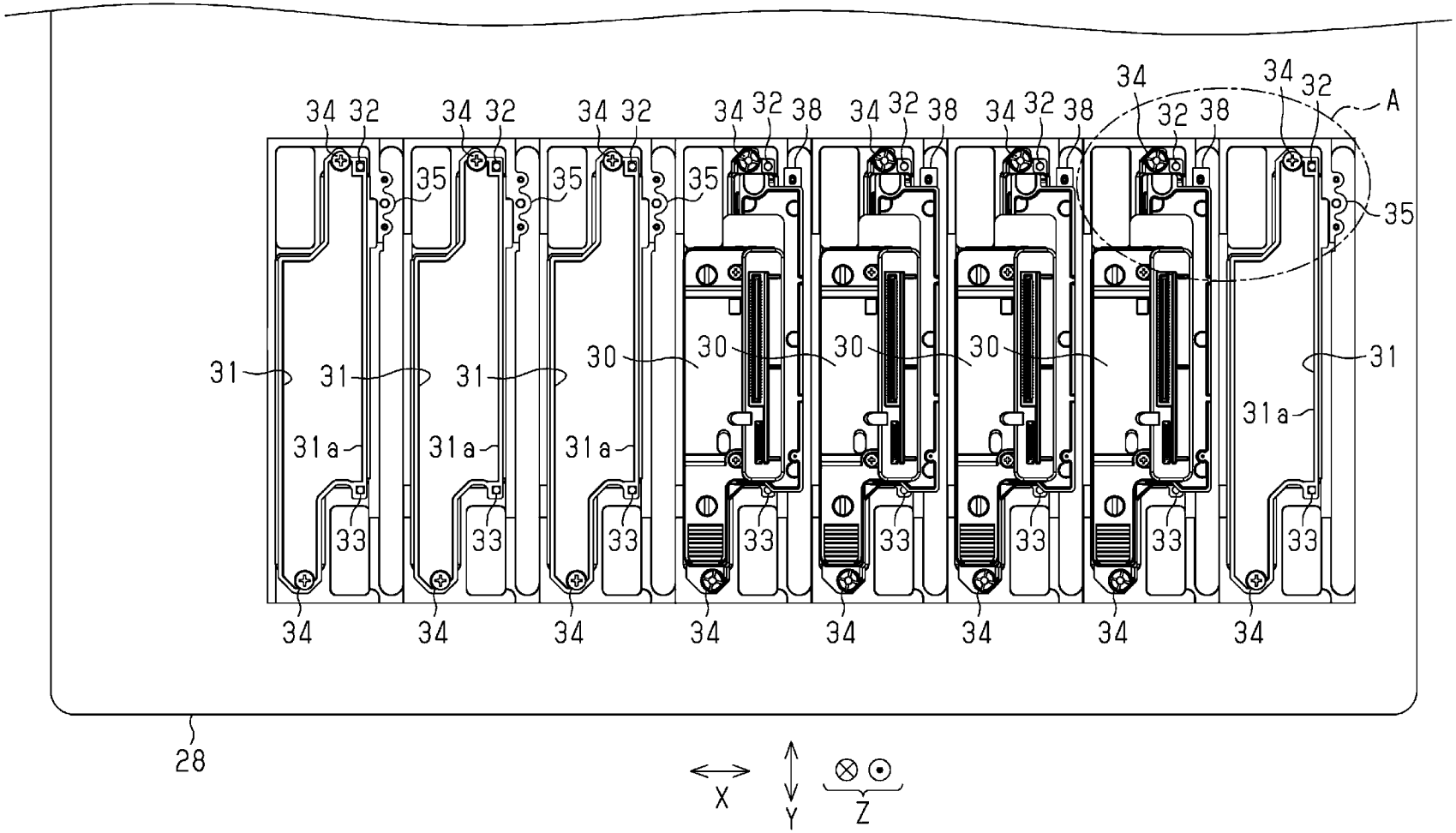
FIG. 2 is a plan view along line 2-2 in FIG. 1.

As shown in FIGS. 1 and 2, a plurality of head bodies 30 capable of jetting droplets are mounted on the frame 28. A plurality of mounting holes 31 are formed in the frame 28 to be arranged in the width direction X. A part of the head body 30 below a midway thereof in the vertical direction Z can be inserted into the mounting hole 31. Each of the mounting holes 31 is a substantially rectangular through hole of which a longitudinal direction follows the depth direction Y. In the present embodiment, eight mounting holes 31 are arranged in the width direction X as an example. Further, as shown in FIG. 2, four head bodies 30 are mounted in four adjacent mounting holes 31 which are second to fifth from the right side among the eight mounting holes 31.

Figure 3:
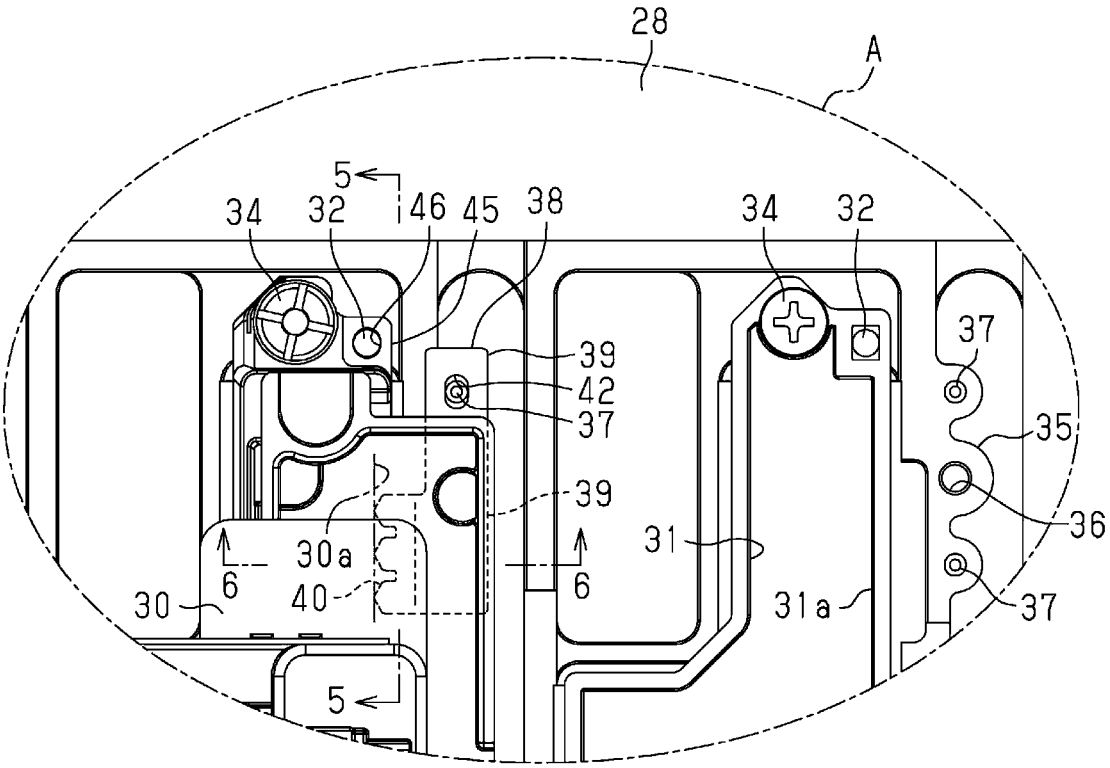
FIG. 3 is an enlarged plan view showing a part of FIG. 2.

As shown in FIG. 2 and FIG. 3, a pair of pins 32 and 33 arranged in the depth direction Y are provided, for example, on an extending line of one long side 31*a*, which is a right side in FIG. 2, of two long sides of the frame 28 in the longitudinal direction of the mounting hole 31. The pin 32 and the pin 33 protrude upward in the vertical direction Z. In the two pins 32 and 33 paired in the depth direction Y, the upper pin 32 is referred to as a first pin 32, and the lower pin 33 is referred to as a second pin 33 in FIG. 2. Both the first pin 32 and the second pin 33 are located on the extending line of the one long side 31*a* at the peripheral edge of the mounting hole 31 and are used as a reference for positioning when the head body 30 is mounted on the frame 28. In other words, a position of the head body 30 in the width direction X and the depth direction Y is determined by the first pin 32 and the second pin 33. In the frame 28, a screw fastening unit 34 which allows the head body 30 partly inserted into the mounting hole 31 from above to be fixed to the frame 28 is provided at each of edge portions on one side and the other side of a peripheral edge portion of the mounting hole 31 in the depth direction Y.

FIG. 3 shows an enlarged view of a portion A surrounded by an ellipse formed by an alternate long and short dash line in FIG. 2. As shown in FIG. 3, in the frame 28, a mounting seat 35 having electrical conductivity is provided on a portion of a peripheral edge along the one long sides 31*a* at a position on the peripheral edge of the mounting hole 31 which is near the first pin 32. A screw hole 36 is formed in a center portion of the mounting seat 35 in the depth direction Y, and positioning pins 37 used to position a grounding portion 38 which will be described below are provided on both sides with the screw hole 36 interposed therebetween in the depth direction Y. The positioning pins 37 protrude upward in the vertical direction Z. The mounting seat 35 is grounded via a grounding wire (not shown) provided in the device body 12, and when the head body 30 is mounted in the corresponding mounting hole 31, the head body 30 is grounded via the grounding portion 38 mounted on the mounting seat 35.

Figure 4:
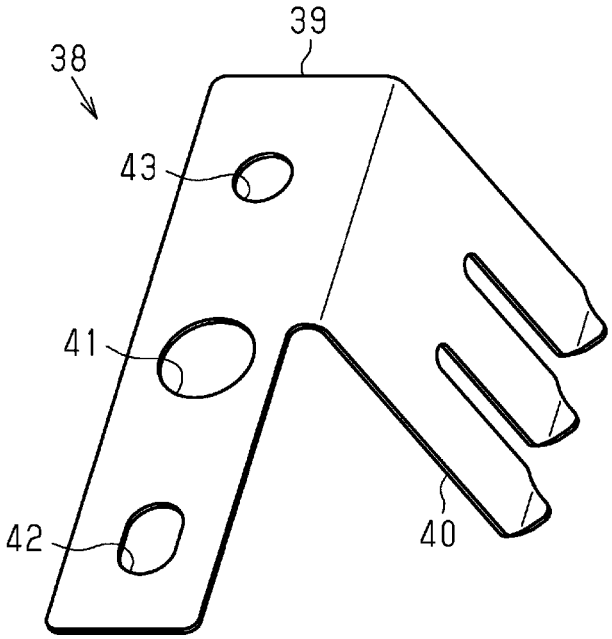
FIG. 4 is a perspective view of a sheet metal member which forms a grounding portion.

As shown in FIG. 4, the grounding portion 38 is a sheet metal member formed of a metal material having electrical conductivity, such as aluminum, for example, and includes a long plate-shaped mounting plate portion 39 mounted on the mounting seat 35, and a contact piece portion 40 which extends obliquely from a part of a side edge of the mounting plate portion 39 in the longitudinal direction. A screw insertion hole 41 corresponding to the screw hole 36 of the mounting seat 35 is formed in a center portion of the mounting plate portion 39 in the longitudinal direction. Additionally, a long hole 42 corresponding to one positioning pin 37 of the mounting seat 35 and a circular hole 43 corresponding to the other positioning pin 37 are formed on both sides of the mounting plate portion 39 in the longitudinal direction with the screw insertion hole 41 interposed therebetween.

Figure 5:
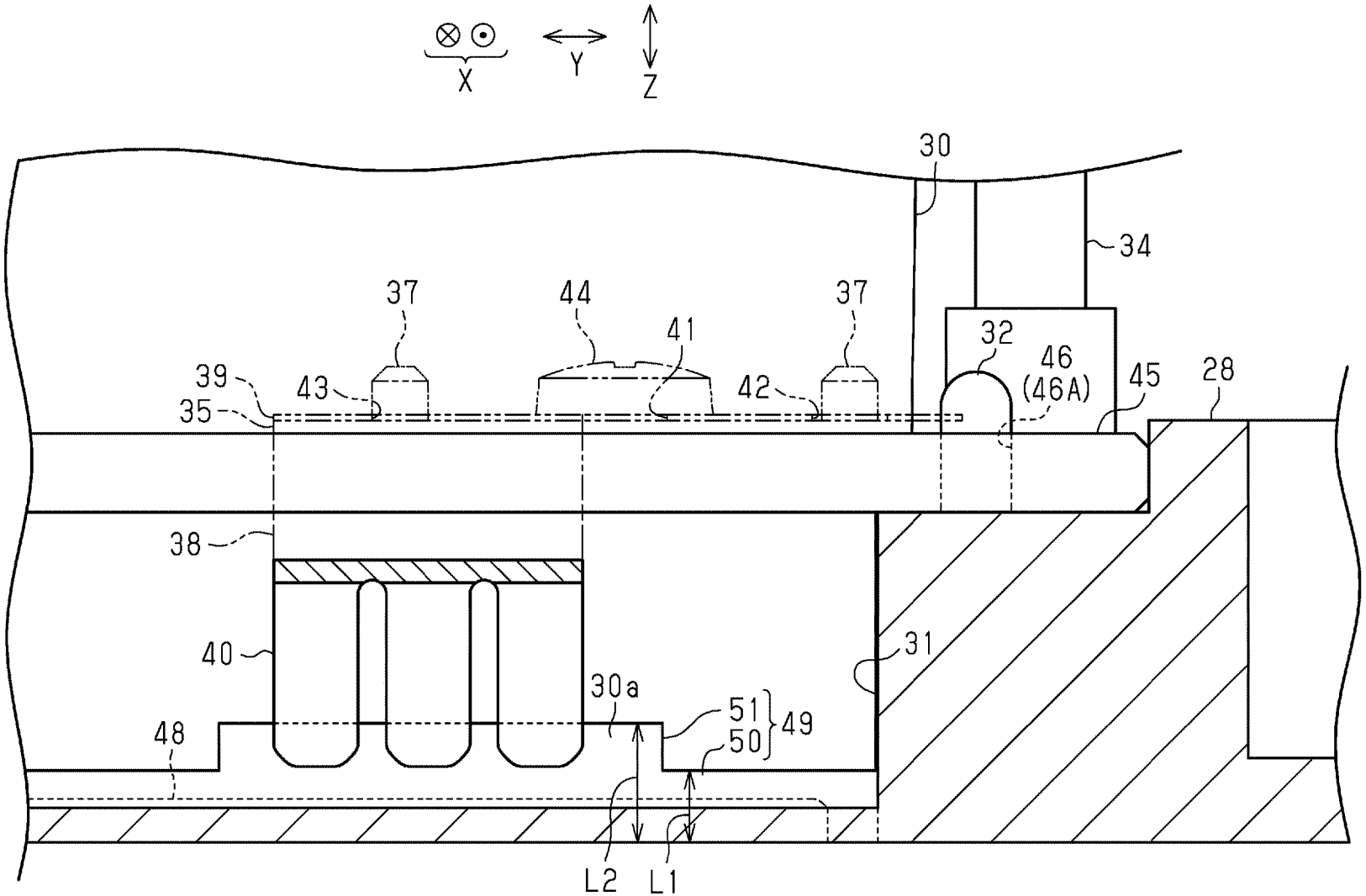
FIG. 5 is a cross-sectional view taken along line 5-5 in FIG. 3.

As shown in FIG. 5, when the grounding portion 38 is mounted on the mounting seat 35, the one positioning pin 37 of the mounting seat 35 is inserted through the long hole 42 of the mounting plate portion 39, and the other positioning pin 37 of the mounting seat 35 is positioned and inserted into the circular hole 43 of the mounting plate portion 39. Then, in the grounding portion 38, in a state in which the screw insertion hole 41 of the mounting plate portion 39 is aligned with the screw hole 36 of the mounting seat 35, and the mounting plate portion 39 is in surface contact with the mounting seat 35, a tip end of the contact piece portion 40 which is an elastic piece comes into contact with a side surface of the head body 30. At this time, the contact piece portion 40 of the grounding portion 38 is elastically deformed and comes into contact with a first side surface 30*a* which is one of side surfaces of the head body 30 partially inserted from above into the mounting hole 31 of the frame 28 that follows the one long side 31*a* of the mounting hole 31 on the side corresponding to the mounting seat 35. Then, the grounding portion 38 is fixed to the mounting seat 35 of the frame 28 by a locking screw 44 inserted into the screw hole 36 via the screw insertion hole 41.

Figure 6:
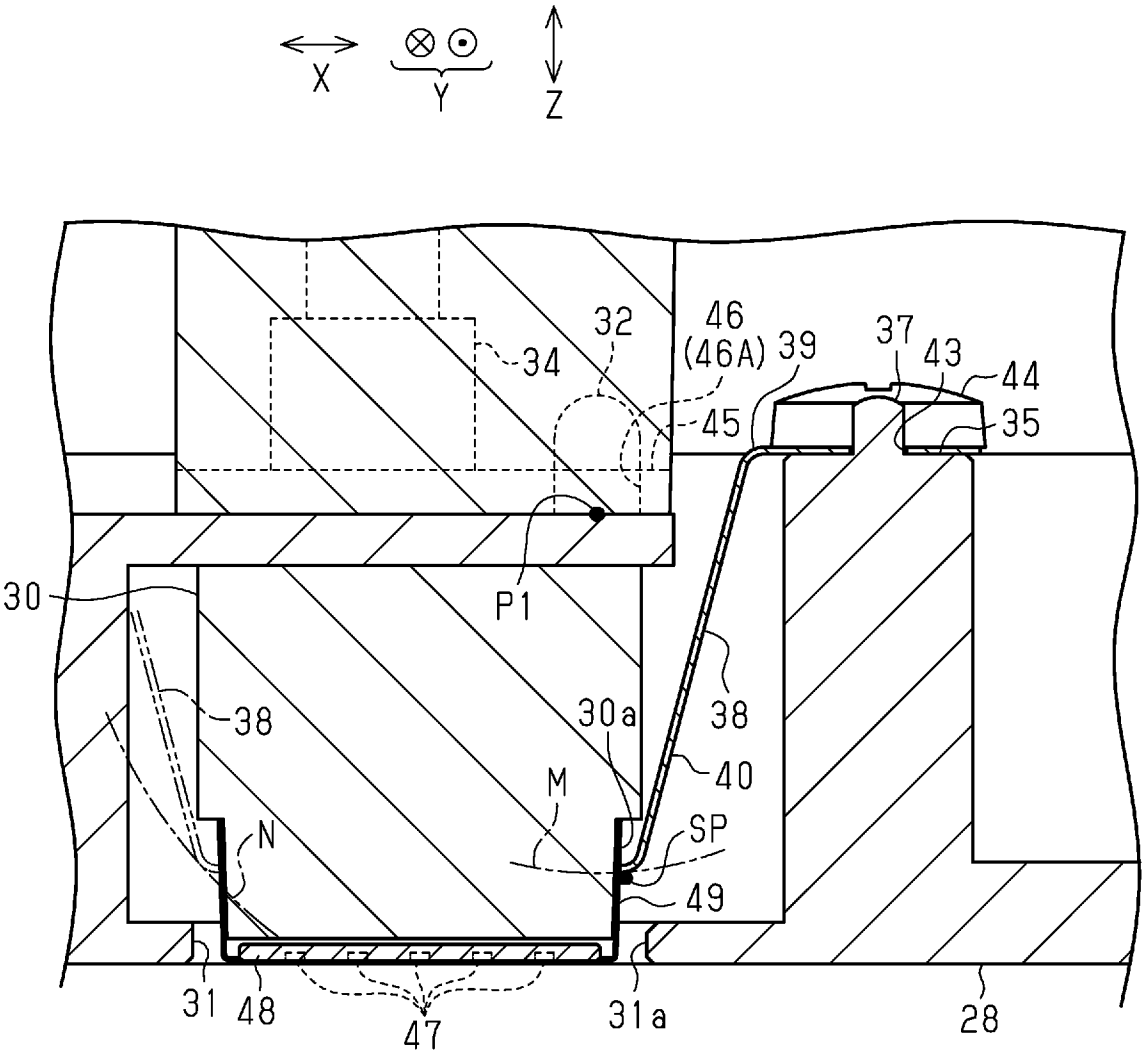
FIG. 6 is a cross-sectional view taken along line 6-6 in FIG. 3.

As shown in FIG. 5 and FIG. 6, in the head body 30, a mounting flange 45 which is engageable from above with the peripheral edge of the mounting hole 31 in the frame 28 is formed at a midway position on the head body 30 in the vertical direction Z. That is, the mounting flange 45 includes a portion which covers positions of the first pin 32 and the second pin 33 of the frame 28 from above when a portion of the head body 30 on the lower side than the middle in the vertical direction Z is inserted into the mounting hole 31, and positioning holes 46 through which the first pin 32 and the second pin 33 can be inserted are formed in the portion. Incidentally, the positioning hole 46 into which the first pin 32 is inserted is referred to as a first positioning hole 46A.

Here, as shown in FIG. 6, the first side surface 30*a* which is a side surface of the head body 30 with which a tip end of the contact piece portion 40 of the grounding portion 38 is in contact follows the vertical direction Z which is an insertion and removal direction with respect to the mounting hole 31 in a state in which a part of the head body 30 is inserted into the mounting hole 31 of the frame 28. That is, the first side surface 30*a* of the head body 30 follows the vertical direction Z which is also the removal direction from the frame 28 in the head body 30. Furthermore, a contact position SP between the first side surface 30*a* and the grounding portion 38 and a position P1 of the first pin 32 overlap in the width direction X which is a normal direction of the first side surface 30*a*. As seen in FIG. 2, in the width direction X which is the normal direction of the first side surface 30*a*, the position of the second pin 33 also overlaps both the contact position SP and the position P1 of the first pin 32.

In addition, the head body 30 includes a nozzle plate 48 having a nozzle 47 formed on a lower surface thereof to jet droplets, and a fixing plate 49 which supports the nozzle plate 48 from the lower side in a state in which it is electrically conductive to the nozzle plate 48. The fixing plate 49 and the nozzle plate 48 are fixed. The fixing plate 49 has a first region 50 having a first dimension L1 which is a dimension in the vertical direction Z that is also the removal direction from the frame 28 of the head body 30, and a second region 51 having a second dimension L2 larger than the first dimension L1. That is, in the fixing plate 49, portions of the first region 50 and the second region 51 in the vertical direction Z are included in the first side surface 30*a* in the vertical direction Z which is also the removal direction from the frame 28 in the head body 30.

Additionally, as shown in FIG. 5, the contact piece portion 40 of the grounding portion 38 mounted on the mounting seat 35 of the frame 28 is in contact with the second region 51 of the first region 50 and the second region 51 of the fixing plate 49 included in the first side surface 30*a* of the head body 30 which has the second dimension L2 having a large dimension in the vertical direction Z. In this case, the fixing plate 49 is formed of a metal material or the like having electrical conductivity and serves as a conductive portion which conducts with the nozzle plate 48.

Next, operations of the above-described exemplary embodiment will be described.

When the head body 30 is removed from the frame 28, such as during replacement of the head body 30, first, the screw fastening unit 34 which fixes the head body 30 to the frame 28 is loosened. Next, the head body 30 is pulled upward in the vertical direction Z in which the first pin 32 and the second pin 33 of the frame 28 are separated from the pair of positioning holes 46 including the first positioning hole 46A in the mounting flange 45. At this time, rotation occurs in the head body 30 with incremental shaking around the first pin 32 and the second pin 33, as shown in FIG. 6, due to a pulling force of an operator who grips an upper portion of the head body 30.

Here, as shown virtually by a two-dot chain line in FIG. 6, when the tip end of the grounding portion 38 is in contact with the side surface of the head body 30 at a position at which it does not overlap the position P1 of the first pin 32 in the normal direction of the side surface, rotation having a rotational locus N about the position P1 of the first pin 32 occurs at a contact position between the tip end of the grounding portion 38 and the side surface of the head body 30. In the rotation having the rotational locus N, a large force including a component in the vertical direction Z is applied to the contact position on the side surface of the head body 30 with the tip end of the grounding portion 38. Therefore, when the head body 30 is pulled upward in the vertical direction Z together with the rotation having the rotational locus N, a large sliding contact load in the vertical direction Z occurs at the contact position on the side surface of the head body 30 with the tip end of the grounding portion 38.

On the other hand, in the case of the present embodiment, as shown by a solid line in FIG. 6, the tip end of the contact piece portion 40 of the grounding portion 38 is in contact with the first side surface 30*a* of the head body 30 at a position at which it overlaps the position P1 of the first pin 32 in the normal direction of the first side surface 30*a*. Thus, rotation having a rotational locus M about the position P1 of the first pin 32 occurs at the contact position SP between the tip end of the contact piece portion 40 of the grounding portion 38 and the first side surface 30*a* of the head body 30. Here, in the case of the rotation having the rotational locus M, the force including the component in the vertical direction Z is hardly generated. Therefore, when the head body is pulled upward in the vertical direction Z while being incrementally shaken with the rotation having the rotational locus M, the sliding contact load in the vertical direction Z is unlikely to occur at the contact position SP on the first side surface 30*a* of the head body 30 with the tip end of the contact piece portion 40 of the grounding portion 38.

In addition, in the case of the present embodiment, the tip end of the contact piece portion 40 of the grounding portion 38 is in contact with the first side surface 30*a* of the head body 30 at a position at which it overlaps both the position P1 of the first pin 32 and the position of the second pin 33 in the normal direction of the first side surface 30*a*. Thus, the rotation of the head body 30 which occurs when the head body 30 is removed from the frame 28 tends to be the rotation having the rotation locus M with an axis in the depth direction Y passing through the position P1 of the first pin 32 and the position of the second pin 33 as a rotation axis.

Further, in the head body 30, the tip end of the contact piece portion 40 of the grounding portion 38 is in contact with the second region 51 which is a surface region in the vertical direction Z in the fixing plate 49 which fixes the nozzle plate 48 to the head body 30. Therefore, the sliding contact load in the vertical direction Z is also unlikely to occur at the second region 51 of the fixing plate 49 when the head body 30 is removed. Accordingly, a risk of the fixing plate 49 being separated from the lower portion of the head body 30 is reduced. On the other hand, when the head body 30 is mounted on the frame 28, the tip end of the contact piece portion 40 of the grounding portion 38 easily comes into contact with the second region 51 having the second dimension L2 which is a relatively large dimension in the fixing plate 49 in the vertical direction Z.

Next, effects of the exemplary embodiment described above will be described.

(1) When the head body 30 is removed from the frame 28, for example, during replacement of the head body 30, rotation may occur with incremental shaking around the first pin 32 with respect to the head body 30. In such a case, when the contact position SP between the first side surface 30*a* and the grounding portion 38 and the position P1 of the first pin 32 are at different positions in the normal direction of the first side surface 30*a* of the head body 30, a sliding contact load in the removal direction from the frame 28 occurs easily at the contact portion on the first side surface 30*a* of the head body 30 with the grounding portion 38. In this regard, in the present embodiment, the contact position SP between the first side surface 30*a* of the head body 30 and the grounding portion 38 and the position P1 of the first pin 32 overlap in the normal direction of the first side surface 30*a*. Therefore, a sliding contact load in the removal direction from the frame 28 is unlikely to occur at the contact portion on the first side surface 30*a* of the head body 30 with the grounding portion 38, and thus it is possible to reduce a risk of damage to the head body 30.

(2) When the head body 30 is removed from the frame 28, the rotation having the rotational locus M with respect to the head body 30 occurs with incremental shaking with the axis passing through the position P1 of the first pin 32 and the position of the second pin 33 as the rotation axis. Therefore, a sliding contact load in the removal direction from the frame 28 is unlikely to occur at the contact portion with the grounding portion 38 on the first side surface 30*a* of the head body 30.

(3) When the head body 30 is removed from the frame 28, a sliding contact load in the removal direction from the frame 28 is not likely to occur at the contact portion between a portion of the fixing plate 49 included in the first side surface 30*a* of the head body 30 and the grounding portion 38, and thus the risk of the fixing plate 49 being separated from the head body 30 can be reduced.

(4) When the head body 30 is positioned on the frame 28, the grounding portion 38 can be easily brought into contact with the second region 51 which is the portion of the fixing plate 49 included in the first side surface 30*a*.

(5) When the head body 30 is removed from the frame 28 in which the first pin 32 is inserted into and positioned in the first positioning hole 46A, a sliding contact load in the removal direction from the frame 28 is unlikely to occur in the fixing plate 49 which serves as a conductive portion that conducts with the nozzle plate 48, and the risk of damage to the head body 30 can be reduced.

(6) The head body 30 can be easily positioned and mounted on the frame 28, and when the head body 30 mounted thereon in this way is removed from the frame 28, a sliding contact load with the grounding portion 38 can be curbed and the head body 30 can be easily removed.

The present exemplary embodiment described above may be modified and implemented as follows. The present exemplary embodiment and modified examples thereof to be described below may be implemented in combination within a range in that a technical contradiction does not arise.

In the fixing plate 49, a portion included in the first side surface 30*a* of the head body 30 may be any one of the first region 50 having the first dimension L1 or the second region 51 having the second dimension L2 which are dimensions in the removal direction of the head body 30 from the frame 28. Alternatively, the portion may be a region having another dimension which is not any of these dimensions.

The tip end of the contact piece portion 40 of the grounding portion 38 may be configured to contact the first region 50 rather than the second region 51 of the fixing plate 49.

The head body 30 may have a configuration not including the fixing plate 49.

The tip end of the contact piece portion 40 of the grounding portion 38 may not be in contact with the second region 51 or the first region 50 of the fixing plate 49 and may be in contact with the first side surface 30*a* of the head body 30 rather than the fixing plate 49.

In the normal direction of the first side surface 30*a* of the head body 30, the second pin 33 may be provided at a position at which it does not overlap both the contact position SP between the first side surface 30*a* and the grounding portion 38 and the position P1 of the first pin 32.

Hereinafter, technical concepts and effects thereof that are understood from the above-described exemplary embodiments and modified examples will be described.

(A) A liquid jet device includes a head body configured to jet droplets from a nozzle, a frame on which the head body is positioned, a grounding portion configured to contact a first side surface of the head body in a removal direction from the frame to electrically couple the head body to the frame, and a first pin serving as a pin for positioning the head body with respect to the frame, wherein a contact position between the first side surface and the grounding portion and a position of the first pin overlap in a normal direction of the first side surface.

For example, when the head body is removed from the frame, such as during replacement of the head body, the rotation with respect to the head body may occur with incremental shaking around the first pin. In such a case, when the contact position between the first side surface and the grounding portion and the position of the first pin are at different positions in the normal direction of the first side surface of the head body, a sliding contact load in the removal direction from the frame easily occurs at the contact portion of the first side surface of the head body with the grounding portion. In this regard, according to the above-described configuration, since the contact position between the first side surface of the head body and the grounding portion and the position of the first pin overlap in the normal direction of the first side surface, a sliding contact load in the removal direction from the frame is unlikely to occur at the contact portion of the first side surface of the head body with the grounding portion, and the risk of damage to the head body can be reduced.

(B) As the pin, the liquid jet device may include a second pin which overlaps with both the contact position and the position of the first pin in the normal direction.

According to such a configuration, when the head body is removed from the frame, rotation having a rotation locus with incremental shaking with respect to the head body with an axis passing through the position of the first pin and the position of the second pin as a rotation axis occurs. Therefore, a sliding contact load in the removal direction from the frame can be made unlikely to occur at the contact portion of the first side surface of the head body with the grounding portion.

(C) In the above-described liquid jet device, the head body may include a nozzle plate on which the nozzle is formed and a fixing plate which supports the nozzle plate in a state in which the fixing plate conducts with the nozzle plate, a portion of the fixing plate may be included in the first side surface, and the grounding portion may be in contact with the portion of the fixing plate included in the first side surface.

According to such a configuration, when the head body is removed from the frame, the sliding contact load in the removal direction from the frame is unlikely to occur at a contact portion between a portion of the fixing plate included in the first side surface of the head body and the grounding portion, and thus the risk of the fixing plate being separated from the head body can be reduced.

(D) In the liquid jet device, the portion of the fixing plate included in the first side surface may include a first region with a dimension in the removal direction being a first dimension, and a second region with a dimension in the removal direction being a second dimension larger than the first dimension, and the grounding portion may be configured to contact the second region.

According to such a configuration, when the head body is positioned on the frame, the grounding portion can be easily brought into contact with the portion of the fixing plate included in the first side surface.

(E) A head body positioned at a frame includes a nozzle plate where a nozzle configured to jet droplets is formed, a first side surface including a conductive portion that is electrically coupled to the nozzle plate and is along a removal direction from the frame, and a first positioning hole into which a first pin for positioning the head body with respect to the frame is inserted, wherein the conductive portion and the first positioning hole overlap in a normal direction of the first side surface.

According to such a configuration, when the head body is removed from the frame in which the first pin is inserted into and positioned in the first positioning hole, a sliding contact load in the removal direction from the frame is unlikely to occur in the conductive portion, and the risk of damage to the head body can be reduced.

(F) A mounting method for positioning and mounting a head body on a frame, comprising:

bringing a grounding portion which conducts the head body with the frame into contact with a first side surface of the head body along a removal direction from the frame, inserting the first pin into a first positioning hole of the head body at a position at which it overlaps a contact position between the first side surface and the grounding portion in a normal direction of the first side surface, and positioning the head body on the frame.

According to such a configuration, the head body can be easily positioned at and mounted on the frame, and when the head body mounted in this way is removed from the frame, a sliding contact load with the grounding portion can be curbed and the head body can be easily removed.

What is claimed is:

1. A liquid jet device comprising:

a head body configured to jet droplets from a nozzle;

a frame where the head body is positioned;

a grounding portion configured to contact a first side surface of the head body which is a surface along a removal direction from the frame, to electrically couple the head body to the frame; and a first pin serving as a pin for positioning the head body with respect to the frame, wherein a contact position between the first side surface and the grounding portion and a position of the first pin overlap in a normal direction of the first side surface.

2. The liquid jet device according to claim 1, comprising a second pin as the pin, wherein a position of the second pin overlaps both the contact position and the position of the first pin in the normal direction.

3. The liquid jet device according to claim 1, wherein the head body includes a nozzle plate at which the nozzle is formed, and a fixing plate that is electrically coupled to the nozzle plate and supports the nozzle plate, a portion of the fixing plate is included in the first side surface, and the grounding portion contacts the portion of the fixing plate included in the first side surface.

4. The liquid jet device according to claim 3, wherein the portion of the fixing plate included in the first side surface includes a first region with a dimension in the removal direction being a first dimension, and a second region with a dimension in the removal direction being a second dimension larger than the first dimension, and the grounding portion is configured to contact the second region.

5. A head body positioned at a frame, comprising:

a nozzle plate at which a nozzle configured to jet droplets is formed;

a first side surface including a conductive portion that is electrically coupled to the nozzle plate and is along a removal direction from the frame; and a first positioning hole into which a first pin for positioning the head body with respect to the frame is inserted, wherein the conductive portion and the first positioning hole overlap in a normal direction of the first side surface.

6. A mounting method for positioning and mounting a head body at a frame, comprising:

bringing a grounding portion for electrically coupling the head body with the frame into contact with a first side surface of the head body along a removal direction from the frame;

inserting the first pin into a first positioning hole of the head body at a position, at which the first pin overlaps a contact position between the first side surface and the grounding portion in a normal direction of the first side surface, to position the head body at the frame.

* * * * *